US006053251A

United States Patent [19]

Deaton

[11] Patent Number: 6,053,251

[45] Date of Patent: Apr. 25, 2000

[54] REDUCED TRAVEL OPERATING MECHANISM FOR DOWNHOLE TOOLS

[75] Inventor: Thomas M. Deaton, Farmers Branch, Tex.

[73] Assignee: Halliburton Energy Services, Inc., Dallas, Tex.

[21] Appl. No.: 09/058,056

[22] Filed: Apr. 9, 1998

Related U.S. Application Data

[60] Provisional application No. 60/046,585, May 15, 1997.

[51] Int. Cl.[7] ..... E21B 34/14

[52] U.S. Cl. ..... 166/321; 166/319; 166/332.8; 251/58; 251/63.4; 251/279; 251/280

[58] Field of Search ..... 166/321, 319, 166/332.8; 251/58, 63.4, 279, 280

[56] References Cited

U.S. PATENT DOCUMENTS

| | | | |
|---|---|---|---|
| 2,780,290 | 9/1957 | Natho | 166/72 |
| 2,798,561 | 12/1957 | Tru | 166/321 |
| 3,799,258 | 3/1974 | Tausch | 166/72 |
| 4,050,670 | 9/1977 | Borg et al. | 251/14 |
| 4,161,219 | 7/1979 | Pringle | 166/324 |
| 4,256,283 | 3/1981 | Reneau et al. | 251/62 |
| 4,444,266 | 4/1984 | Pringle | 166/324 |
| 4,456,217 | 6/1984 | Winegeart et al. | 251/58 |
| 4,457,376 | 7/1984 | Carmody et al. | 166/332 |
| 4,519,576 | 5/1985 | Winegeart | 251/62 |
| 4,576,358 | 3/1986 | Mott et al. | 251/14 |
| 4,828,183 | 5/1989 | Flink, Jr. | 239/569 |
| 4,860,991 | 8/1989 | Blizzard et al. | 251/62 |
| 5,058,682 | 10/1991 | Pringle | 166/324 |
| 5,358,053 | 10/1994 | Akkerman | 166/321 |
| 5,411,096 | 5/1995 | Akkerman | 166/321 |
| 5,564,675 | 10/1996 | Hill, Jr. et al. | 251/62 |
| 5,678,633 | 10/1997 | Constantine, Jr. | 166/319 |

*Primary Examiner*—Eileen Dunn Lillis
*Assistant Examiner*—John Kreck
*Attorney, Agent, or Firm*—Paul I. Herman; Marlin R. Smith

[57] ABSTRACT

A reduced travel operating mechanism for downhole tools is provided. The reduced travel operating mechanism (57) includes a load ratio system (59) which may include compression ring (102) disposed within circumferential guide pocket (123) and a linkage system (61) disposed within mechanism pocket (125). The linkage system (61) may include first link (112), master link (114), and second link (116) coupled between compression ring (102) and connecting member (118). A loading system (63), which may include a hydraulic piston (100), acts on compression ring (102) to move compression ring (102) a first distance. Connecting member (118) moves a second distance in response to the movement of compression ring (102) a first distance. The linkage system (61) may operate such that the second distance is greater than the first distance or operate such that the first distance is greater than the second distance. A biasing system (139), which may include springs (104), may be included to bias compression ring (102) in a first position.

17 Claims, 5 Drawing Sheets

FIG. 5
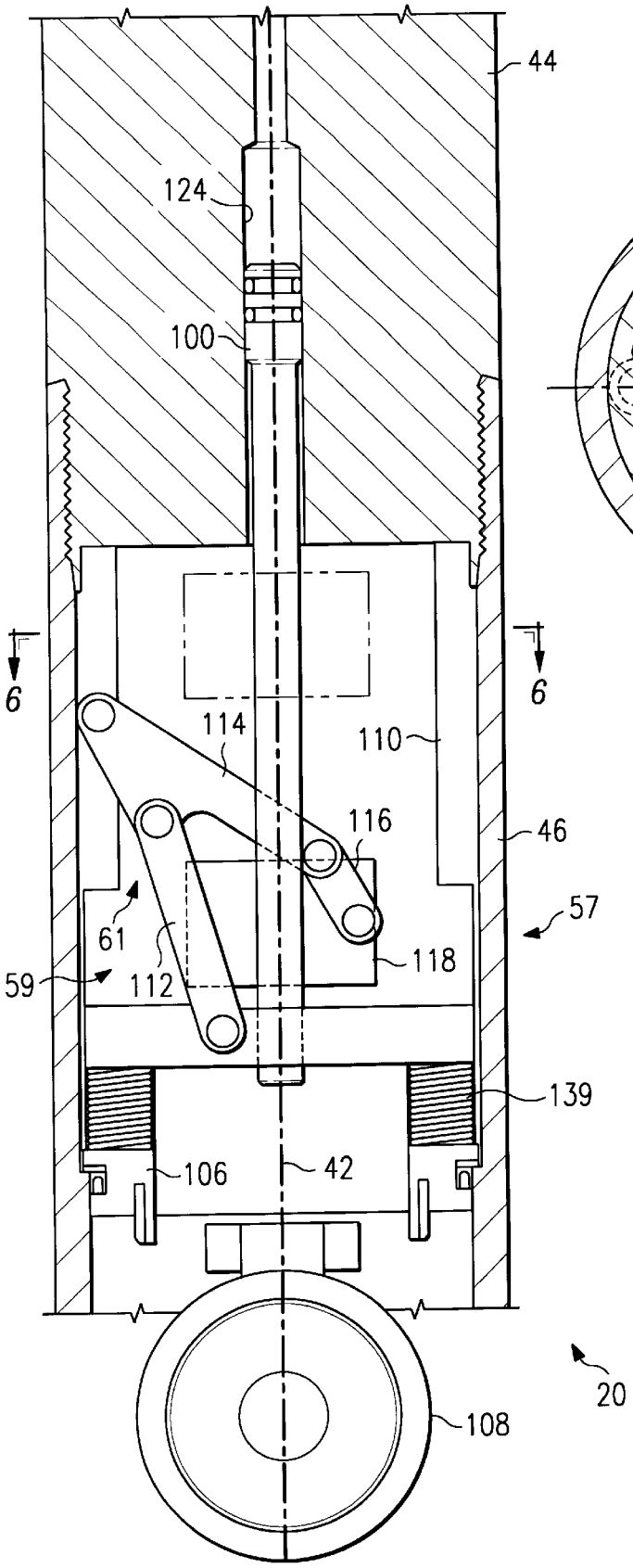
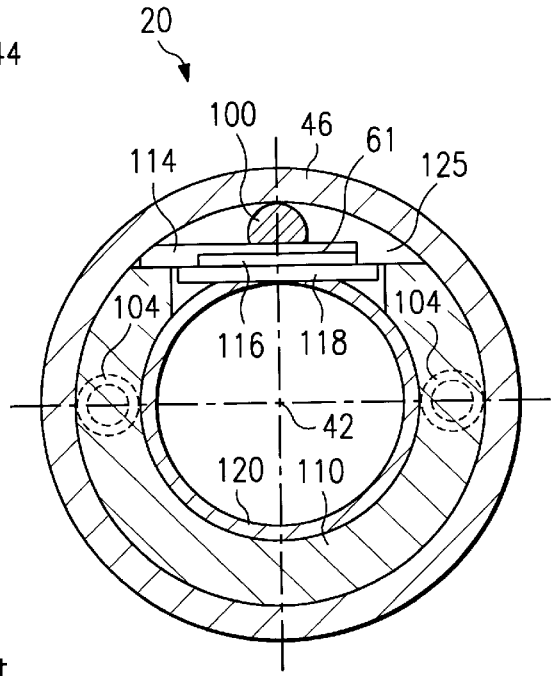
FIG. 6

FIG. 7
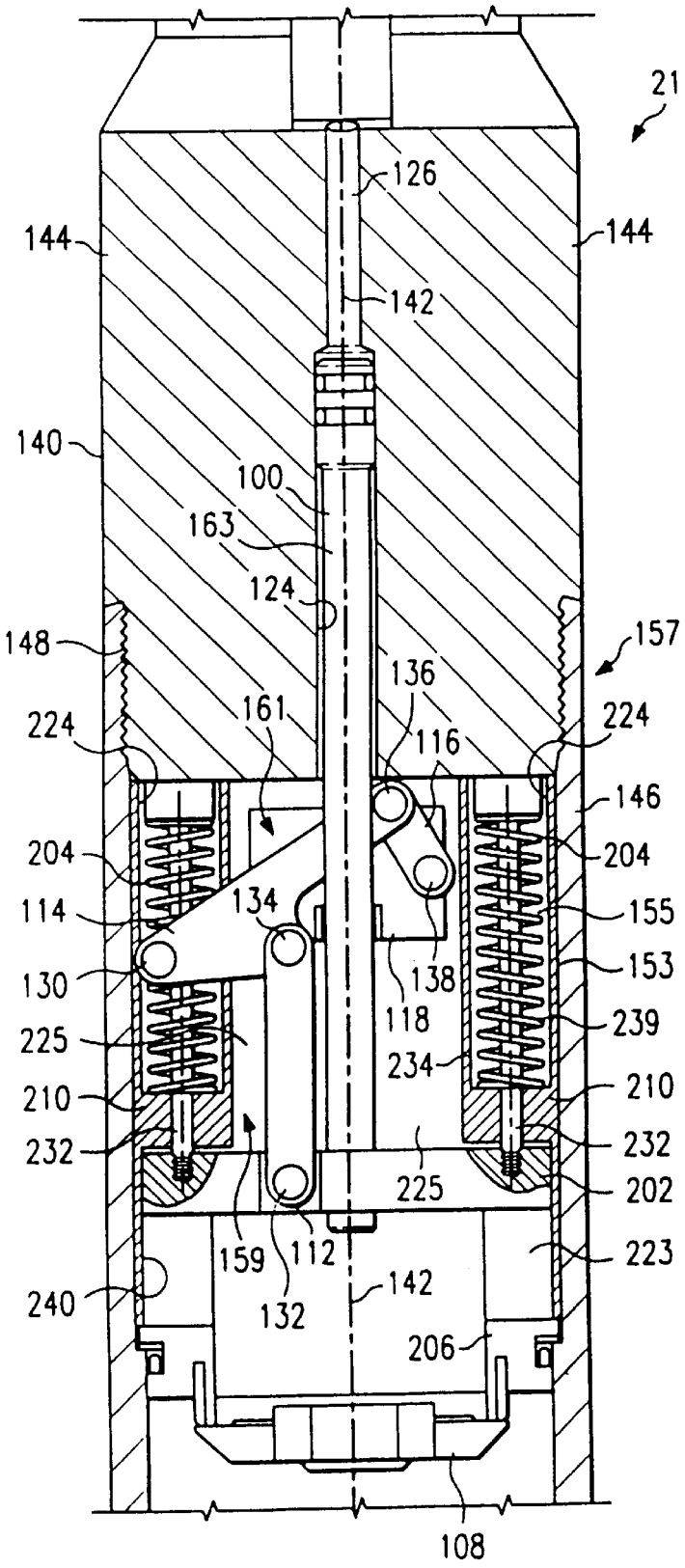
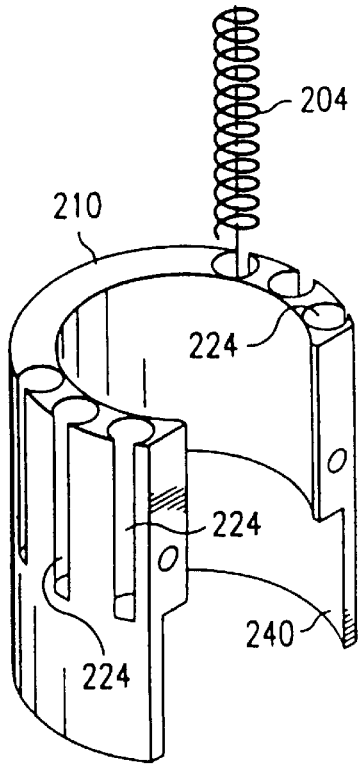
FIG. 8

REDUCED TRAVEL OPERATING MECHANISM FOR DOWNHOLE TOOLS

CROSS-REFERENCE TO RELATED APPLICATIONS

This application claims priority under 35 USC § 119(e) of provisional application No. 60/046,585, filed May 15, 1997.

TECHNICAL FIELD OF THE INVENTION

This invention relates generally to downhole tools used in the oil and gas industry, and more particularly to a reduced travel operating mechanism for downhole tools.

BACKGROUND OF THE INVENTION

It is a common practice in the oil and gas industry to use downhole tools in completed and producing oil and gas wells. These downhole tools vary in purpose, but are generally used for well maintenance, flow control, or safety. To illustrate the operating mechanism of a typical downhole tool, the operating system of a subsurface safety valve is described below.

A subsurface safety valve is generally located deep in a producing well and is often included in a production tubing string. Well fluid flows through the production tubing string and the subsurface safety valve to the well surface, where the well fluids are diverted through valves into pipes for transport or storage. The subsurface safety valve acts as a downhole flow control device to block well fluid during emergency conditions. The subsurface safety valve is typically designed to allow well fluid to flow through the production tubing string to the surface when positive control is exerted over the subsurface safety valve from the well surface. Typical surface controlled subsurface safety valves are disclosed in U.S. Pat. No. 4,527,631, entitled Subsurface Safety Valve and U.S. Pat. No. 4,325,431, entitled Flow Controlling Apparatus, each of which is incorporated into this application by reference.

The positive control over the subsurface safety valve is generally in the form of hydraulic pressure applied at the well surface, which is communicated through a conduit to a hydraulic piston contained within the subsurface safety valve. The hydraulic pressure from the well surface opens a valve member contained within the subsurface safety valve and allows well fluid to pass through the production tubing string to the surface of the well. When positive control, or hydraulic pressure, is removed, the subsurface safety valve will close and stop the flow of well fluid through the production tubing string. During an emergency, the hydraulic pressure is removed either by an actuator at the well surface or by damage to the hydraulic conduit, thereby stopping the flow of well fluid to the well surface.

Many subsurface safety valves are constructed using a flapper type valve member to open or close the well flow. A flapper type valve is generally opened by a sleeve which is directly connected to a hydraulic piston within the subsurface safety valve. The hydraulic piston is activated by hydraulic pressure from the well surface which extends the sleeve to a second position to open the flapper type valve and hold it open, allowing unrestricted flow of the well fluid to the surface. A spring or other biasing system is often used to bias the sleeve in a non-extended or first position, thereby allowing well fluid to close the flapper type valve member and block well fluid flow to the well surface when hydraulic pressure is removed from the hydraulic piston.

SUMMARY OF THE INVENTION

Accordingly, a need has arisen for an improved operating mechanism for downhole tools. The present invention provides a downhole tool operating mechanism that addresses shortcomings of prior downhole operating mechanisms.

In accordance with one embodiment of the present invention, a downhole tool reduced travel operating mechanism is provided. The downhole tool may include a body having a generally hollow, cylindrical configuration and formed from at least one housing subassembly. The downhole tool body includes a longitudinal axis, an inner diameter and an outer diameter. A wall is defined by the inner and outer diameters of the downhole tool body. A reduced travel operating mechanism is disposed within the wall of the downhole tool body. The reduced travel operating mechanism operates a downhole effector. The downhole effector may be any device that performs an operation or function in the well, such as maintenance, flow control, or safety operation. In one embodiment of a downhole tool, a subsurface safety valve, the end effector is a sleeve that moves longitudinally within the subsurface safety valve to open a flapper type valve mechanism.

A reduced travel operating mechanism in accordance with an embodiment of the present invention may include a loading system which acts on the downhole effector through a load ratio system. A connecting member may be used in conjunction with the reduced travel operating mechanism to connect the downhole effector to the load ratio system.

The loading system may comprise any system for exerting a force on the load ratio system. For example, the loading system may include an electronic actuator or hydraulic bellows as disclosed in U.S. Pat. No. 5,411,096, entitled Surface Controlled, Subsurface Tubing Safety Valve.

The load ratio system comprises a system for varying the load and/or travel of the loading system acting on the downhole effector. For example, the load applied by the load ratio system to the downhole effector may be smaller or larger than the load applied to the load ratio system by the loading system. In another example, the travel of the downhole effector may be smaller or larger than the travel of the loading system. The load ratio system allows the load and/or travel of the downhole effector to be varied to suit the application. In other words, the load ratio system changes the ratio of the travel and/or load of the downhole effector to the loading system.

In many applications, a biasing system may be included that acts on the load ratio system to bias the downhole effector in a first position. The biasing system may comprise any system for exerting a biasing force on the downhole effector. For example, the biasing system may include a single long spring, a compressible gas cartridge, or a series of beam type springs as disclosed in U.S. Pat. No. 5,358,053, entitled Subsurface Safety Valve.

In one embodiment, a pocket is formed within the wall of the downhole tool body. The load ratio system may include a compression ring and a linkage system disposed within the pocket of the downhole tool body. The loading system acts on the compression ring to vary the position of the compression ring within the pocket. The linkage system may be coupled between the compression ring and the connecting member or the downhole effector such that the movement of the compression ring a first distance causes movement of the connecting member/downhole effector a second distance. In one embodiment, the linkage system operates such that the first distance is smaller than the second distance. In another embodiment, the linkage system operates such that the first distance is greater than the second distance. In a further embodiment, the linkage system operates such that the load applied by the loading system is less than the load applied by the linkage system on the connecting member. In an additional embodiment, the linkage system operates such that the load applied by the loading system is greater than the load applied by the linkage system on the connecting member. Other embodiments may include varying the load and/or travel of the connecting member or downhole effector.

In a subsurface safety valve incorporating an embodiment of the present invention, an annular area is formed between the outside diameter of the sleeve and the inside diameter of the housing. A cartridge and a support are each disposed within the annular area of the housing and form a pocket which includes a mechanism pocket and a circumferential guide pocket. The compression ring may be an annular ring disposed within the circumferential guide pocket and limited to longitudinal movement within the circumferential guide pocket. In one embodiment, the spring system comprises at least one spring disposed within the circumferential guide pocket between the support and the compression ring.

The linkage system may comprise a first link rotatably coupled to both the compression ring and a master link. The first link is rotatably coupled to the master link at a first radius. The master link may be rotatably coupled to a fixed location. A second link is rotatably coupled to both the master link and the connecting member. The second link is rotatably coupled to the master link at a second radius. The second radius is larger than the first radius. In this embodiment, the connecting member is slidably disposed within the pocket and connected to the sleeve. Thus, a small longitudinal change in the position of the compression ring results in a much larger change in the position of the sleeve.

In general, if the loading system is not activated, the biasing system will maintain the compression ring in a first position, thereby maintaining the sleeve in a nonextended or first position, which allows the flapper type valve mechanism to close in response to the well fluid, thereby stopping well fluid from passing through the production tubing string to the surface of the well. If the loading system is activated, the loading system compresses the biasing system and moves the compression ring to a second position which moves the sleeve to a second position, thereby extending the sleeve and opening the flapper type valve mechanism, which allows well fluid to pass through the production tubing string to the surface of the well. When the loading means is no longer activated, the spring or biasing system returns the compression ring back to the first position, which moves the sleeve back to a first position, allowing the flapper type valve mechanism to close and stop well fluid from flowing through the production tubing string to the surface of the well.

Technical advantages of the present invention include providing a downhole tool having a shorter spring or biasing system. The shorter springs allow for less expensive springs to be utilized and reduces the overall length of the downhole tool, thereby reducing the expense associated with the springs and the expense associated with the materials used to manufacture the downhole tool.

A further technical advantage of the present invention is that the operating mechanism of the downhole tool can be designed to provide variable loading to the downhole effector, such as the sleeve used in the subsurface safety valve.

An additional technical advantage of the present invention is that the reduced travel operating mechanism may be arranged to multiply or reduce the force and/or the travel of the loading system as applied to the downhole effector.

Other technical advantages will be readily apparent to one skilled in the art from the following figures, descriptions, and claims.

BRIEF DESCRIPTION OF THE DRAWINGS

For a more complete understanding of the present invention and for further features and advantages, reference is now made to the following description taken in conjunction with the accompanying drawings, in which:

FIG. 5 is a schematic drawing in section with portions broken away of the subsurface safety valve shown in FIG. 4 in an extended or second position;

FIG. 6 is a drawing in section taken along lines 6—6 of FIG. 5;

FIG. 7 is a schematic drawing in section with portions broken away of a subsurface safety valve incorporating another embodiment of the present invention; and FIG. 8 is an exploded orthographic projection illustrating the position of the springs in the cartridge.

DETAILED DESCRIPTION OF THE DRAWINGS

The preferred embodiments of the present inventing and its advantages are best understood by referring in more detail to FIGS. 1–8 of the drawings, in which like numerals refer to like parts throughout the several views.

Figure 1:
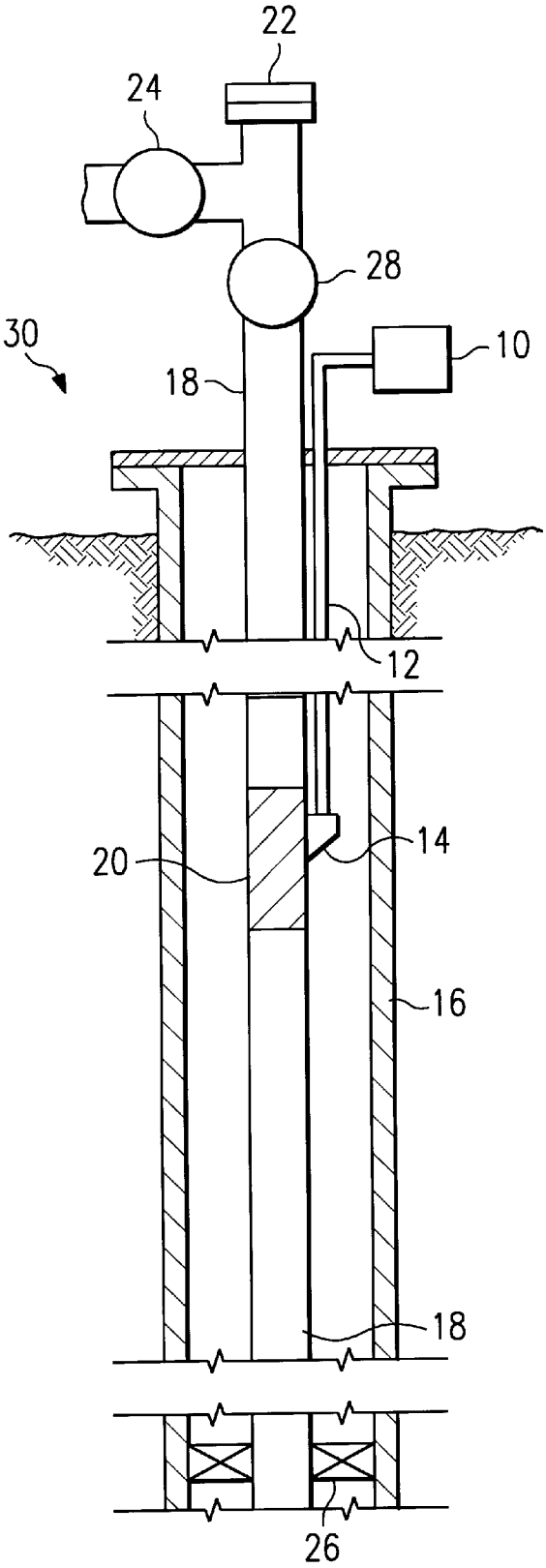
FIG. 1 is a schematic drawing in section with portions broken away of a typical producing oil or gas well which includes a subsurface safety valve.

FIG. 1 is a schematic view of a typical producing oil or gas well 30. Well 30 includes production tubing string 18 from the surface of the well 30 to an oil and gas bearing rock formation (not expressly shown) deep underground. Packing material 26 is preferably located above the oil or gas producing formation between production tubing string 18 and casing 16, to direct the flow of formation fluid or well fluids to the surface through production tubing string 18. The formation fluid or well fluid enters production tubing string 18 below packing material 26 through perforations (not shown) in production tubing string 18. Subsurface safety valve 20 is disposed within production tubing string 18 as an integral part thereof such that the well fluid must flow through subsurface safety valve 20. Subsurface safety valve 20 is operated by a control system 10 which typically includes a hydraulic pump and manifold to supply high pressure hydraulic fluid. Hydraulic pressure is generally applied through control line 12 and connector 14 to subsurface safety valve 20.

Valves 24 and 28 are preferably provided at the surface of well 30 to control the flow of well fluids from production tubing string 18. Well cap 22 is also provided to allow access to the interior of production tubing string 18 for maintenance and inspection.

FIGS. 2–5 are schematic drawings in longitudinal section with portions broken away of subsurface safety valve 20 incorporating one embodiment of the present invention. Subsurface safety valve 20 includes housing assembly 40 which has a generally hollow, cylindrical configuration (FIG. 6) with longitudinal axis 42 extending therethrough and an outer diameter. For the embodiment shown in FIG. 2, housing assembly 40 is defined in part by upper housing subassembly 44 and lower housing subassembly 46. Housing subassemblies 44 and 46 are concentrically journaled with each other by threaded connection 48. Threaded connection 50 and 52 are provided for use in connecting subsurface safety valve 20 within production tubing string 18.

Sleeve 120 has a generally hollow cylindrical configuration and is slidably disposed within housing assembly 40. A wall 53 of downhole tool 20 is defined between an outer diameter of housing assembly 40 and an outside diameter of sleeve 120 (FIG. 6). An annular area 55 may be formed within the wall of housing assembly 40. For the embodiment shown in FIG. 2, the annular area 55 is formed in housing assembly 40. Disposed within wall 53 of housing assembly 40 is the various components of reduced travel operating mechanism 57.

Upper housing subassembly 44 may include hydraulic fluid passage 126 for attachment with connector 14 and control line 12. Hydraulic passage 126 is connected to variable volume fluid chamber 124 formed in wall 53 of housing 40 (FIG. 6). Hydraulic piston 100 is slidably disposed within variable volume fluid chamber 124 (FIG. 6). Hydraulic piston 100 is coupled to compression ring 102. The hydraulic piston 100 may form a loading system 63 that operates to exert a force on the compression ring 102.

Cartridge 110 is disposed within annular area 55 in lower housing subassembly 46 and forms mechanism pocket 125 and circumferential guide pocket 123. Support 106 is disposed within the annular area in lower housing subassembly 46 and defines a portion of circumferential guide pocket 123.

A load ratio system 59, which may comprise a compression ring 102 and a linkage system 61, is disposed within circumferential guide pocket 123 and mechanism pocket 125. Compression ring 125 may be longitudinally movable within circumferential guide pocket 123. The design of compression ring 102 may be varied depending upon the particular use of reduced travel operating mechanism 57. For example, compression ring 102 may have an annular ring configuration, a rectangular configuration, or may form a component of the linkage system.

The linkage system 61 is disposed in part within mechanism pocket 125 and may include first link 112, master link 114, and second link 116. For the embodiment shown in FIGS. 2–5, first link 112 is coupled between master link 114 and compression ring 102 at rotatable hinge 134 and 132, respectively. Master link 114 is coupled to a fixed location on cartridge 110 at rotatable hinge 130. First link 112 is coupled to master link 114 at a first radius. Second link 116 is coupled between master link 114 and connecting member 118 at rotatable hinge 136 and 138, respectively. Connecting member 118 is coupled to sleeve 120.

A biasing system 139 may be included in the reduced travel operating mechanism. The biasing system 139, which may comprise at least one spring 104 may be disposed within circumferential guide pocket 123 between support 106 and compression ring 102. Springs 104 act on compression ring 102 to provide a biasing force to maintain compression ring 102 in a non-extended or first position. Support 106 may include a hinge mechanism for flapper type valve mechanism 108.

The load ratio system 59 may operate such that the movement of the compression ring 102 a first distance causes movement of the connecting member 118 and the sleeve 120 a second distance. For the embodiment shown in FIGS. 2–5, the first distance is smaller than the second distance. However, the present inventive concept is not limited to the first distance being smaller than the second distance. The present inventive concept includes the embodiments which multiply or reduce the load and/or travel of sleeve 120 with respect to compression ring 102.

Figure 2:
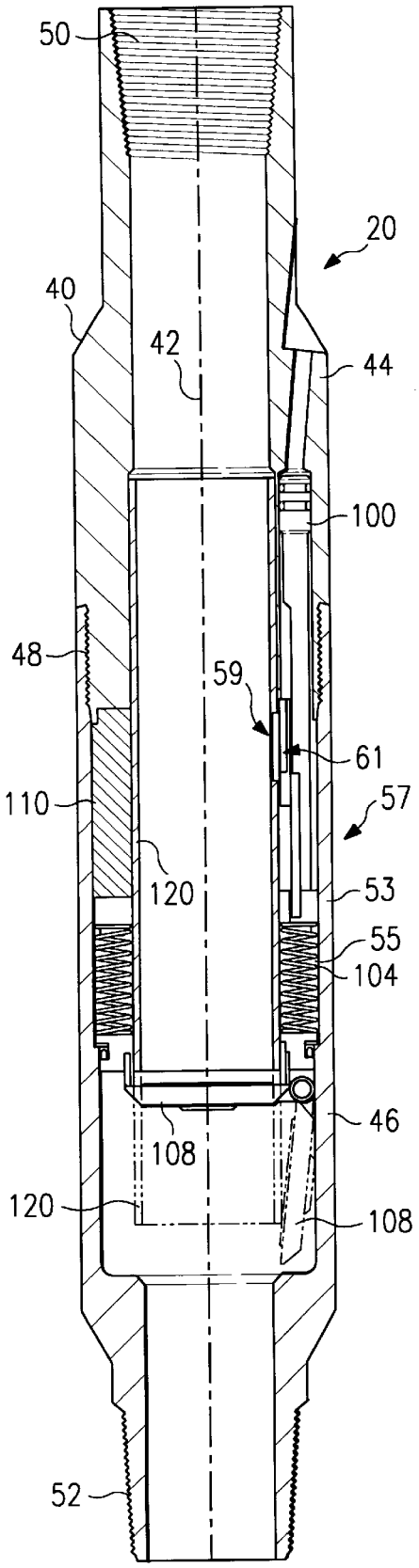
FIG. 2 is a schematic drawing in section with portions broken away of a subsurface safety valve incorporating one embodiment of the present invention in its closed or first position.
Figure 3:
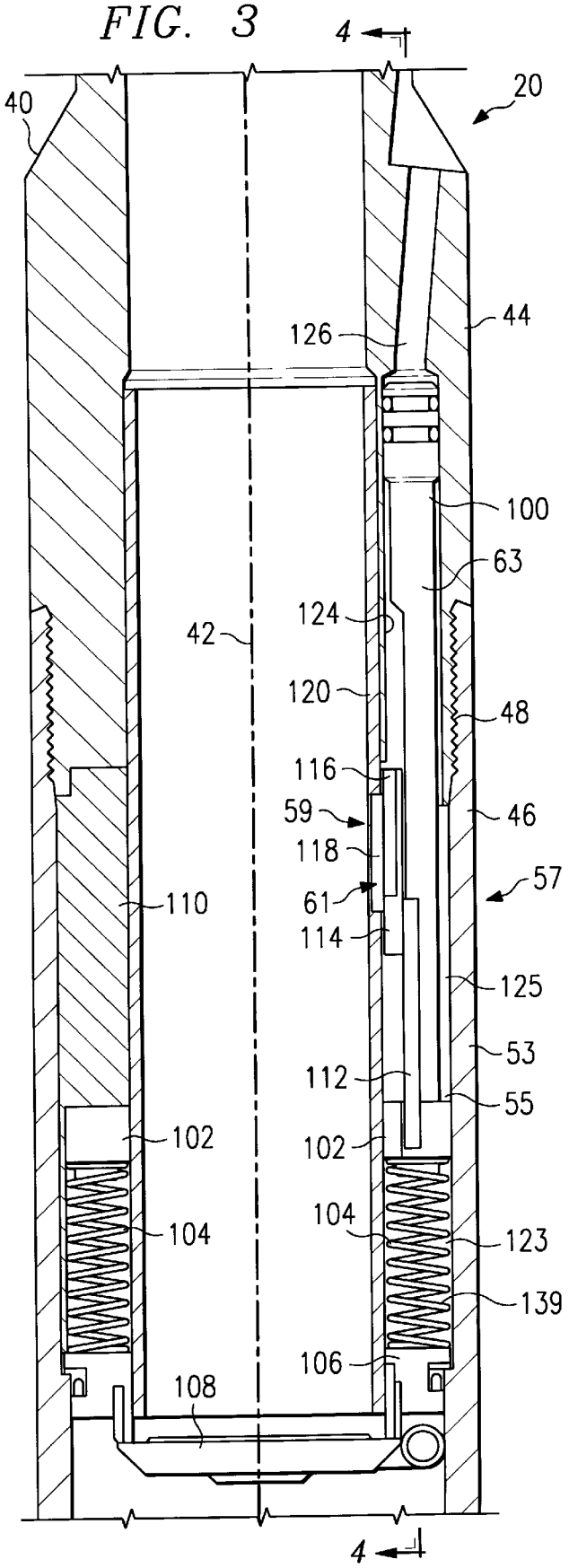
FIG. 3 is an enlarged drawing in section with portions broken away of the subsurface safety valve shown in FIG. 2.

The solid lines in FIGS. 2 and 3 illustrate sleeve 120 in a non-extended or first position. With sleeve 120 in the first position, flapper type valve mechanism 108 closes in response to pressure from well fluid flowing through production tubing string 18. The dotted lines in FIG. 2 illustrate sleeve 120 in the extended or second position. Sleeve 120 extends and forces open flapper type valve mechanism 108. With flapper type valve mechanism 108 open and sleeve 120 fully extended, a full bore passage is provided through subsurface safety valve 20 to allow well fluid to pass unrestricted through production tubing string 18 to the surface of well 30.

The operation of the reduced travel operating mechanism 57 as used in the subsurface safety valve 20 embodiment is described below. FIG. 5 shows the reduced travel operating mechanism 57 in the extended or second position. The second position is reached by applying high pressure hydraulic fluid from control system 10 at the surface of well 30 to subsurface safety valve 20 through control line 12 and connector 14. The high pressure hydraulic fluid enters variable volume fluid chamber 124 through hydraulic fluid passage 126. The high pressure hydraulic fluid in variable volume fluid chamber 124 acts on hydraulic piston 100, forming a longitudinal force on hydraulic piston 100 which compresses springs 104 and moves hydraulic piston 100 and compression ring 102 to the second position. The movement of compression ring 102 causes a corresponding movement in first link 112 which causes master link 114 to rotate about hinge 130. The rotation of master link 114 causes second link 116 and connecting member 118 to move. Due to the spatial relationships of first link 112 to master link 114, master link 114 to second link 116, and second link 116 to connecting member 118, a small longitudinal displacement in compression ring 102 is converted into a large longitudinal displacement in connecting member 118 and sleeve 120. Sleeve 120 is thereby longitudinally moved to the second position, extending sleeve 120 through flapper type valve mechanism 108 to open flapper type valve mechanism 108, allowing full-bore flow of well fluid through subsurface safety valve 20.

The spatial relationships between first link 112, master link 114, second link 116 and connecting member 118 may be changed to allow a variable load to be transmitted through connecting member 118 to sleeve 120. Thus, the load through connecting member 118 may be maximized when sleeve 120 initially contacts flapper type valve mechanism 108 and may then be reduced as sleeve 120 extends to the second position.

Figure 4:
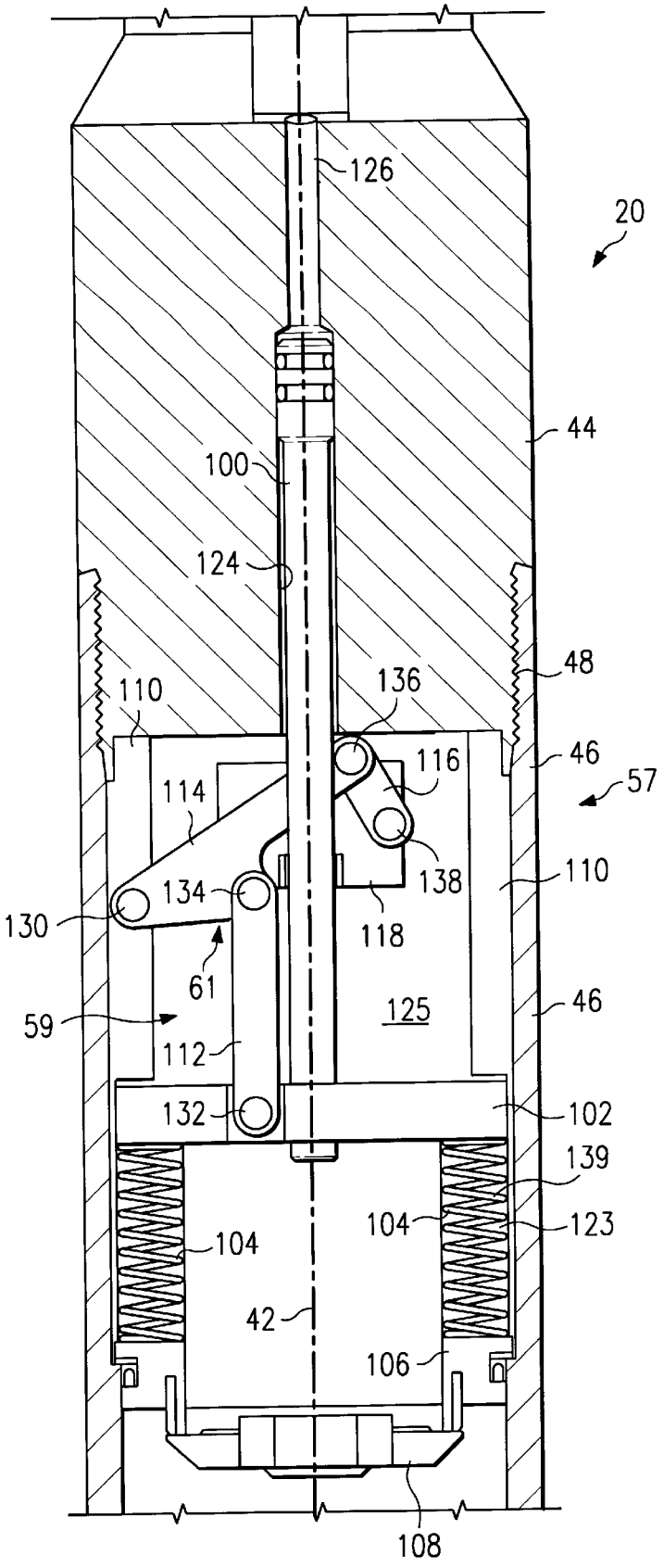
FIG. 4 is a schematic drawing in section with portions broken away of the subsurface safety valve shown in FIG. 3 taken along lines 4—4 of FIG. 3.

FIG. 4 shows the reduced travel operating mechanism 57 in a non-extended or first position. The first position occurs when the high pressure hydraulic fluid from control system 10 is removed, the hydraulic fluid in variable volume fluid chamber 124 does not have sufficient pressure to overcome the biasing force applied by springs 104. Springs 104 act on compression ring 102 and moves compression ring 102 and piston 100 into the non-extended or first position. This action causes sleeve 120, through the linkage system, to longitudinally move into a non-extended or first position. Sleeve 120 no longer holds open flapper type valve mechanism 108 and pressure from the well fluid flowing through production tubing string 18 closes flapper type valve mechanism 108, thereby stopping well fluid from flowing through subsurface safety valve 20 to the surface of well 30.

FIG. 7 is a schematic drawing in longitudinal section with portions broken away of subsurface safety valve 21 incorporating another embodiment of the present invention. Subsurface safety valve 21 as shown in FIG. 7 is in the non-extended or first position. Subsurface safety valve 21 includes housing assembly 140 which has a generally hollow, cylindrical configuration with longitudinal axis 142 extending therethrough. For the embodiment shown in FIG. 7, housing assembly 140 is defined in part by upper housing subassembly 144 and lower housing subassembly 146. Housing subassemblies 144 and 146 are concentrically journaled with each other by threaded connection 148.

Sleeve 120 is slidably disposed within housing assembly 140. Sleeve 120 has a generally hollow, cylindrical configuration. A wall 153 of downhole tool 21 is defined between the outer diameter of housing assembly 140 and the outside diameter of sleeve 120. For the embodiment shown in FIG. 7, an annular area 155 is formed in lower housing subassembly 146. Disposed within wall 153 of housing assembly 140 is the various components of the reduced travel operating mechanism 157.

Upper housing subassembly 144 may include hydraulic fluid passage 126 for attachment with connector 14 and control line 12. Hydraulic passage 126 is connected to variable volume fluid chamber 124 formed in wall 153 of housing 140. Hydraulic piston 100 is slidably disposed within variable volume fluid chamber 124. Hydraulic piston 100 is coupled to compression ring 202.

Cartridge 210 is disposed within annular area 155 in lower housing subassembly 146 and forms mechanism pocket 225, circumferential guide pocket 223 and spring pocket 224. Support 206 is disposed within the annular area in lower housing subassembly 146. Compression ring 202 may be an annular ring disposed within circumferential guide pocket 223 and longitudinally movable at surface 240 within circumferential guide pocket 223. Springs 204 are disposed within spring pocket 224 as illustrated in FIG. 8. A spring retainer 232 connects springs 204 to compression ring 202 such that springs 204 are compressed between spring retainer 232 and cartridge 210 when compression ring 202 is moved by hydraulic piston 100. Springs 204 form a biasing system 239 which acts on compression ring 202 to provide a biasing force to maintain compression ring 202 in a non-extended or first position. Support 206 may include a hinge mechanism for flapper type valve mechanism 108.

Disposed within mechanism pocket 225, linkage system 61 is coupled between compression ring 202 and connecting member 118 such that movement of compression ring 202 a first distance causes movement of the sleeve 120 a second distance, wherein the first distance is smaller than the second distance. The linkage system may comprise first link 112, master link 114, and second link 116. The operation of linkage system 61 is the same as described in FIGS. 2–6.

Reduced travel operating mechanism 157, as shown in FIG. 7, may comprise loading system 163 and a load ratio system 159. The loading system 163 may comprise hydraulic piston 100. The load ratio system 159 may comprise compression ring 202 and a linkage system 161 that comprises first link 112, master link 114, and second link 116 coupled between compression ring 202 and connecting member 118. A biasing system 239, which may comprise at least one spring 204 and spring retainer 232 may be included in the reduced travel operating mechanism 157.

Although the reduced travel operating mechanism is illustrated and described with reference to subsurface safety valve, the inventive concept of the present invention may also apply to other downhole tools, such as a remote actuated sliding sleeve.

In addition, although the present invention has been described with multiple embodiments, various changes and modifications may be suggested to one skilled in the art. It is intended that the present invention encompass such changes and modifications as fall within the scope of the following claims.

What is claimed is:

1. An operating mechanism for controlling the movement of a downhole tool effector between first and second positions, comprising:

a loading system operative to selectively create a first force;

a leveraged load ratio system interconnecting the loading system and the downhole tool effector and being operative to receive the first force and responsively move the downhole tool effector from its first position to its second position with a second force different from the first force; and a biasing system yieldingly biasing the downhole tool effector toward its first position.

2. A reduced travel operating mechanism for controlling a downhole tool effector comprising:

a loading system;

a load ratio system connected between the loading system and the downhole tool effector; and a biasing system acting on the load ratio system and yieldingly biasing the downhole tool effector toward a first position, the loading system being selectively operable to exert a force on the load ratio system in a manner overcoming the bias and moving the downhole tool effector to a second position, the load ratio system comprising:

a force receiving portion, the biasing system acting on the force receiving portion to bias it toward a first position, and the loading system acting on the force receiving portion to overcome the bias and move the force receiving portion to a second position;

a linkage system coupled between the force receiving portion and the downhole tool effector, the downhole tool effector having a first position and a second position related to the first and second positions of the force receiving portion, a first distance being defined by the travel between the first position and the second position of the force receiving portion, and a second distance, different than the first distance, being defined by the travel between the first position and the second position of the downhole tool effector.

3. The reduced travel operating mechanism of claim 2, wherein the second distance is greater than the first distance.

4. The reduced travel operating mechanism of claim 2, wherein the linkage system comprises:

a first link coupled between the force receiving portion and a master link, the first link being coupled to the master link at a first radius;

the master link being rotatably coupled to a fixed support;

a second link coupled between the master link and the downhole tool effector, the second link being coupled to the master link at a second radius; and the first radius being smaller than the second radius.

5. The reduced travel operating mechanism of claim 2, wherein the loading system includes a hydraulic actuator.

6. The reduced travel operating mechanism of claim 2, wherein the biasing system comprises at least one spring.

7. A downhole tool for use in a well, the downhole tool comprising:

a tubular body;

a downhole tool effector movable relative to the tubular body; and a reduced travel operating mechanism disposed within the tubular body and operative to control the movement of the downhole tool effector, the reduced travel operating mechanism including a loading system, and a load ratio system coupled between the loading system and the downhole tool effector, the load ratio system comprising:

a force receiving portion coupled to the loading system; and a linkage system coupled between the force receiving portion and the downhole tool effector such that movement of the force receiving portion a first distance causes movement of the downhole tool effector a second distance in a first direction, the first distance being smaller than the second distance.

8. The downhole tool of claim 7, further comprising a biasing system acting on the load ratio system to bias the downhole tool effector in a second direction opposite from said first direction.

9. The downhole tool of claim 7, wherein the loading system comprises a hydraulic piston.

10. The downhole tool of claim 7, wherein the linkage system comprises:

a first link rotatably coupled between the force receiving portion and a master link, the first link being coupled to the master link at a first radius;

the master link being rotatably coupled to a fixed support;

a second link rotatably coupled between the master link and a connecting member secured to the downhole tool effector, the second link being coupled to the master link at a second radius; and the first radius being smaller than the second radius.

11. The downhole tool of claim 7, further comprising a control system operable to control the loading system.

12. A subsurface safety valve, comprising:

a housing assembly having a longitudinal axis;

a flapper valve disposed within the housing assembly, the flapper valve having an open position and a closed position;

a sleeve axially slidably disposed within the housing assembly and useable to open and close the flapper valve;

a pocket formed between the housing assembly and the sleeve;

a reduced travel operating mechanism disposed within the pocket, the reduced travel operating mechanism comprising:

a force receiving portion movable longitudinally within the pocket;

a linkage system coupled between the force receiving portion and the sleeve and operative in a manner such that a small longitudinal change in position of the force receiving portion causes a greater longitudinal change in the position of the sleeve;

a biasing system exerting a biasing force on the force receiving portion to bias the sleeve toward a first position, the first position of the sleeve corresponding to the closed, position of the flapper valve; and a loading system acting on the force receiving portion to overcome the biasing force and axially move the sleeve toward a second position corresponding to the open position of the flapper valve.

13. The subsurface safety valve of claim 12, wherein the linkage system comprises:

a first link rotatably coupled between the force receiving portion and a master link, the first link being coupled to the master link at a first radius;

wherein the master link is rotatable about a fixed location; and a second link rotatable coupled to the master link at a second radius, and the first radius being smaller than the second radius.

14. The subsurface safety valve of claim 13, wherein the biasing system includes at least one spring.

15. A method of forming a reduced travel operating mechanism to control a downhole tool effector in a downhole tool, comprising the steps of:

forming a pocket within the downhole tool;

movably disposing a force receiving member within the pocket;

biasing the force receiving member toward a first position;

providing a load system operative to load the force receiving member to overcome the bias and move the force receiving member to a second position; and linking the force receiving member to the downhole tool effector such that movement of the force receiving member from its first position to its second position causes movement of the downhole tool effector from a first position to a second position, the movement of the force receiving member between its first position and its second position being smaller than the movement of the downhole tool effector between its first position and its second position.

16. The method of claim 15, wherein the step of biasing the force receiving member toward a first position further comprises the step of providing at least one spring in the pocket.

17. The method of claim 15, wherein the step of loading the force receiving member to overcome the bias and move the force receiving member to its second position further comprises the step of providing a control system to control the position of the force receiving member.

* * * * *